US006116893A

United States Patent [19]

Peach

[11] Patent Number: 6,116,893

[45] Date of Patent: Sep. 12, 2000

[54] BURNER ASSEMBLIES

[75] Inventor: Alan Peach, England, United Kingdom

[73] Assignee: The Aerogen Company Limited, Alton, United Kingdom

[21] Appl. No.: 09/180,462

[22] PCT Filed: Mar. 11, 1998

[86] PCT No.: PCT/GB98/00735

§ 371 Date: Jun. 1, 1999

§ 102(e) Date: Jun. 1, 1999

[87] PCT Pub. No.: WO98/40667

PCT Pub. Date: Sep. 17, 1998

[30] Foreign Application Priority Data

Mar. 11, 1997 [GB] United Kingdom ..... 9704961

[51] Int. Cl.[7] ..... F23D 11/36

[52] U.S. Cl. ..... 431/160; 431/186; 431/189; 239/132.3; 239/587.1

[58] Field of Search ..... 431/186, 189, 431/160; 239/132.3, 587.1

[56] References Cited

U.S. PATENT DOCUMENTS

| | | | |
|---|---|---|---|
| 2,428,271 | 9/1947 | Ensign et al. . | |
| 2,647,569 | 8/1953 | Flynn . | |
| 3,100,461 | 8/1963 | Werner | 431/186 |
| 3,220,803 | 11/1965 | Billi | 431/186 |
| 3,748,100 | 7/1973 | Forseth | 431/186 |
| 4,362,907 | 12/1982 | Polacsek | 179/1 VE |
| 4,781,576 | 11/1988 | Dewitz | 431/186 |
| 5,292,244 | 3/1994 | Xiong | 431/186 |

FOREIGN PATENT DOCUMENTS

| | | |
|---|---|---|
| 4328720 | 3/1995 | Germany . |
| 19638189 | 3/1997 | Germany . |
| 471 641 | 9/1937 | United Kingdom . |
| 627 234 | 8/1949 | United Kingdom . |
| 1 282 515 | 7/1972 | United Kingdom . |

OTHER PUBLICATIONS

PCT WO 97/09859, Mar. 1997.
PCT WO 97/09858, Mar. 1997.
European Patent Application 0411 786 A1, Feb. 1991.
UK Patent Application 2 281 836, Mar. 1995.
PCT WO 97/09861, Mar. 1997.

*Primary Examiner*—Carroll Dority
*Attorney, Agent, or Firm*—Brooks & Kushman P.C.

[57] ABSTRACT

A burner assembly (10) comprising an elongate housing (12) supplied with a gas-air mixture and an elongate burner port body (28) slidably disposed in an elongate aperture (26) in the housing. The position of the burner port body (26) with respect to the housing is adjustable, resulting in a more accurate adjustment of the assembly, since the position of the housing (12) can remain fixed.

17 Claims, 2 Drawing Sheets

BURNER ASSEMBLIES

The present invention relates to burner assemblies and in particular, but not exclusively, to burner assemblies used in the heat treatment of products.

It is known to heat treat products by application of a flame, typically produced by burning a gaseous fuel and contacting the resulting flame with the product to be treated. An example is shown in GB 1534798 (Flynn) in which volatile products are removed from a moving web by passing the web beneath a burner producing a flame sheet extending across the width of the web. There many other heat treatments using burner flames and this is only one example.

When flame-treating products it is important to control the position of the burner with respect to the product being treated in order to ensure that the so-called "active zone" of the flame impinges correctly on the product. It is thus necessary for the position of the burner to be adjustable relative to the product in order to allow for correct positioning of the flame.

Known burner assemblies are in the form of a burner housing having one or more ports through which a gas/air mixture is burned to form one or more flames. The position of the burner assembly relative to the product to be treated is adjusted by moving the burner housing and securing it in the correct position.

However, problems can arise when, for example, wide moving webs of material are being treated. It is not uncommon for such moving webs to be several meters wide, sometimes in excess of six meters wide. The treatment of such webs is carried out by means of burner assemblies of approximately the same length as the width of the web, which are relatively heavy and difficult to manoeuvre. It is thus often difficult to adjust the separation of the burner assembly from the web with the necessary degree of accuracy (typically to an accuracy of 1 mm) and difficult to obtain a constant spacing across the whole width of the web to ensure uniform treatment.

It is an object of the present invention to overcome or alleviate the disadvantages associated with the prior art.

In accordance with the present invention, a burner assembly comprises a burner housing to which a combustible fuel is supplied and a burner port for discharge of combustion products from the burner assembly, characterised in that the position of the burner port is adjustable with respect to the burner body.

By having a burner port movably mounted in the burner housing, it is possible to fix the burner housing in position and to adjust the position of the burner port body within the housing more accurately since a much smaller mass than the burner assembly as a whole is moved, in contrast to the prior art where the position of the entire burner assembly is adjusted.

Preferably, the assembly comprises a burner port body in which the burner port (or a plurality of ports) is provided and the burner port body is movable with respect to the housing. The burner port body may be located in a recess or aperture in the burner housing. The burner port body may be slidably disposed in the recess or aperture.

The recess or aperture in the burner housing may comprise two opposed, substantially parallel walls and the burner port body may have two substantially parallel outer wall surfaces, each of which is in sliding engagement with a respective one of the two opposed walls of the recess or aperture.

The burner port body may comprise two substantially parallel walls and the port may be located between the walls.

There may also be means for adjusting the position of the burner port with respect to the housing. This may comprise one or more adjusting rods screw-threadedly engaged with one of the burner housing and burner port and/or rotatably mounted to one of the burner housing and burner port, whereby rotation of the or each adjusting rod causes relative displacement of the burner housing and the burner port.

There may be one or more cooling chambers (preferably in the vicinity of the burner port) for receipt of cooling fluid.

Preferably the burner housing and the burner port are elongate. It is also possible to connect a plurality of burner assemblies together end to end to form a construction of the desired length.

By way of example only, a specific embodiment of the present invention will now be described, with reference to the accompanying drawings, in which.

Figure 1:
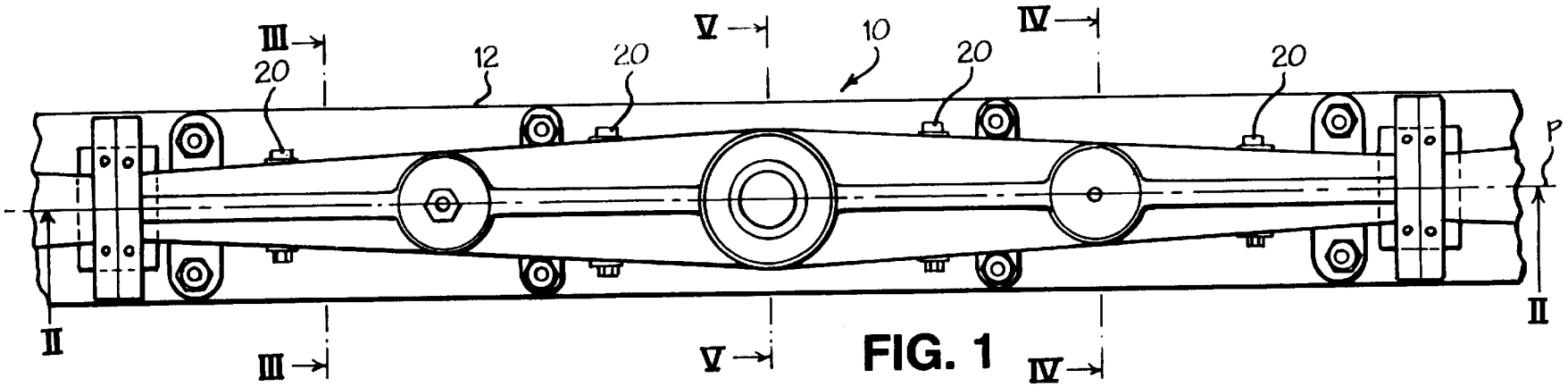
FIG. 1 is a plan view of an embodiment of burner assembly in accordance with the present invention.

A burner assembly 10 comprises an elongate burner housing 12 which is suspended from a manifold 14 by means of adjustable fittings 16. The burner housing 12 is supplied with a gas-air mixture from the manifold via a tubular connector 18 extending between the undersurface of the manifold 14 and the upper surface of the burner housing 12 at its mid-point.

The burner housing is split into two identical halves about a vertical plane P extending through the longitudinal axis of the burner housing and the two burner housing halves are joined by bolt and nut assemblies 20 passing through apertures 22 in the housing halves.

The burner housing comprises an internal chamber 24, a downwardly open aperture 26 for receipt of a burner port body 28 and two longitudinal cooling chambers 30, one disposed on each side of the burner port body 28. Water is fed into each cooling chamber through an inlet nozzle I and leaves the chamber through an outlet nozzle 0. The chamber 24 is generally rectangular in cross-section but its size and cross-section vary along the length of the burner housing. The cross-section is largest at the mid-point of the burner housing, immediately below the tube 18 where the gas-air mixture is introduced from manifold 14 and then gradually reduces in area as the distance from the mid-point increases.

The burner port body 28, which can be of many different constructions and is thus illustrated schematically in the drawings, takes the form of an elongate metal block which is slidably disposed in the elongate aperture 26 in the undersurface of the burner housing. In general terms the burner port body 28 comprises two identical, parallel, elongate burner port body plates 32, each plate being in sliding engagement with a respective one of the vertical walls of the aperture 26 in the burner housing. The two plates are secured in spaced relationship by a plurality of spaced, internally threaded connecting tubes 34 positioned between the opposed plates and by countersunk screws 36 each passing through one of the plates 32 and into one end of a tubular connecting tube 34. A porting arrangement 38 (illustrated schematically), comprising a plurality of ports 39 for discharge of the gas/air mixture in the form of a flame is secured between the inner faces of the two elongate burner port body plates 32 by means of countersunk screws 40, each passing through one of the elongate burner port body plates 32 and into the porting arrangement 38.

Figure 2:
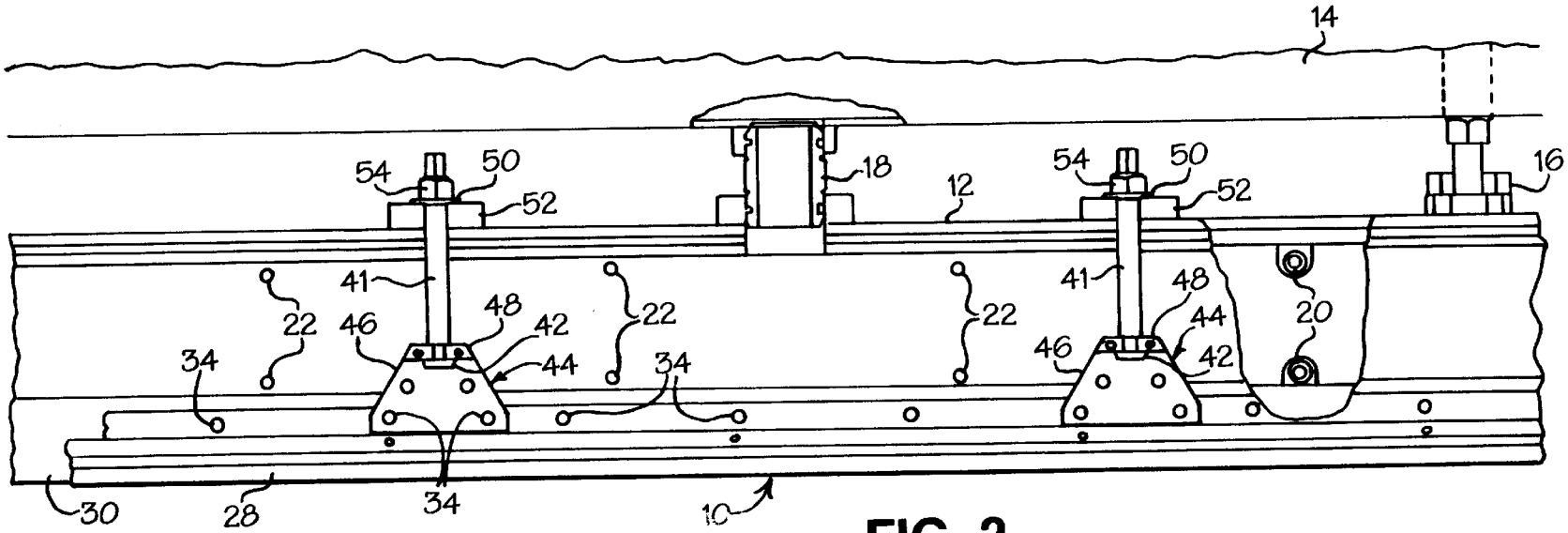
FIG. 2 is a cross-section through the burner assembly of FIG. 1, looking in the direction of arrows II—II.
Figure 3:
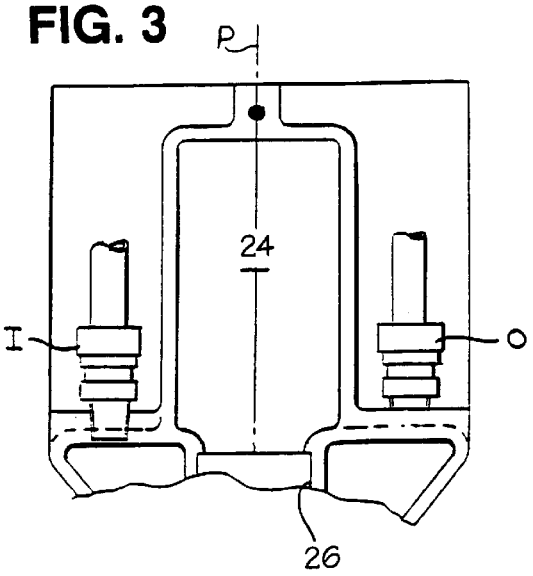
FIG. 3 is a cross-section through the burner assembly of FIG. 1, looking in the direction of arrows III—III.
Figure 4:
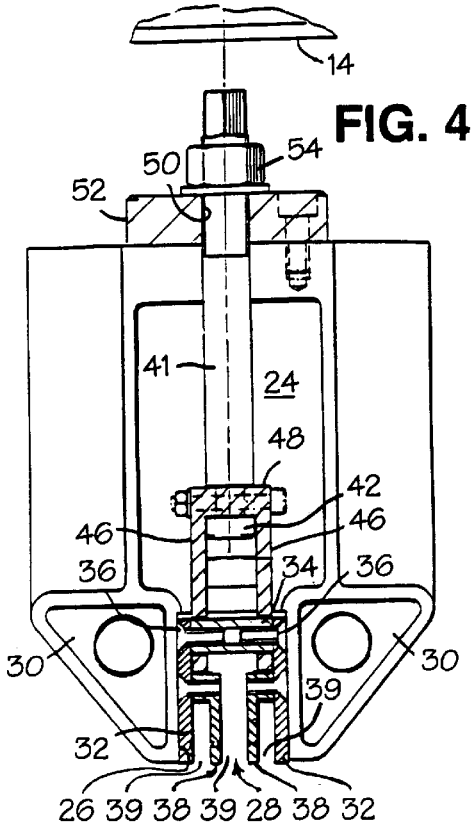
FIG. 4 is a cross-section through the burner assembly of FIG. 1, looking in the direction of arrows IV—IV.
Figure 5:
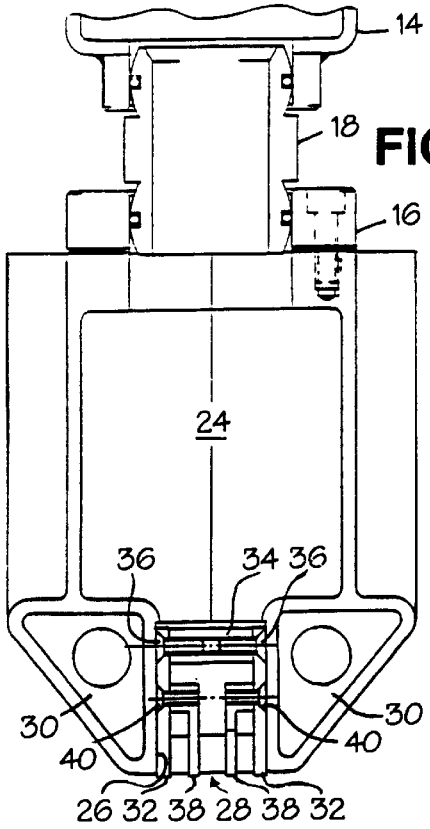
FIG. 5 is a cross-section through the burner assembly of FIG. 1, looking in the direction of arrows V—V.
Figure 6:
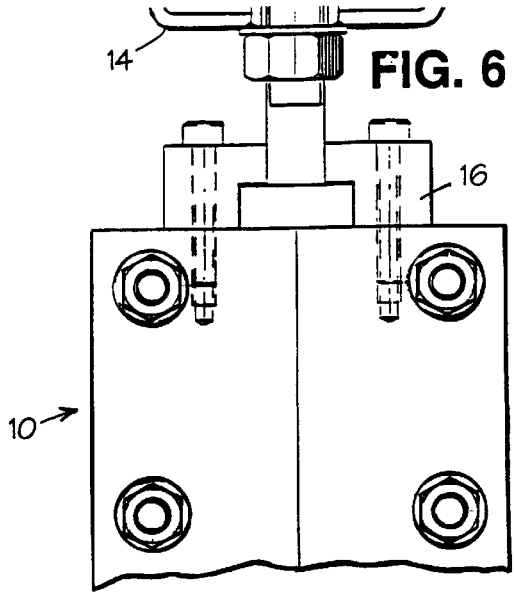
FIG. 6 is an end view of the burner assembly of FIG. 1.

The position of the burner port body 28 within the burner body is adjustable by means of two spaced-apart adjusting rods 41. The lower end of each of the adjusting rods 41 is formed into an enlarged head 42 which is rotatably mounted in a mounting bracket 44 connected to the burner port body 28. The mounting bracket 44 comprises two spaced apart parallel plates 46 bolted to a mounting plate 48 through which the bolt passes and against whose undersurface the enlarged bolt head 42 engages. As seen in FIGS. 2 and 4, two of the threaded connecting tubes 34 also pass through the plates 46, thereby adjustably securing the bolt 40 to the movable burner port body 28. The upper end of each rod 40 is screw-threaded and is engaged with a complementarily-threaded aperture 50 passing through a mounting block 52 secured to the upper surface of the burner housing 12. The position of the rod may be secured by means of a locking nut 54 threadedly disposed on the threaded portion of the rod and engageable with the upper surface of the mounting block 52.

In use, several burner assemblies 10 can be secured to together end-to-end, as illustrated in FIGS. 1 and 2 and secured in position by means of the fittings 16. If several burner housings 12 are fitted together end-to-end then it is still possible for a single burner port body 28 to extend along the whole length of the composite burner body thus formed. Alternatively, each burner housing 12 may be provided with its own associated burner port body 28.

The burner housing is mounted on the manifold 14 and its position is adjusted by means of the adjustable fittings 16. The position of the burner port body 28 within the burner housing 12 can then be very accurately adjusted by means of the screw-threaded adjusting rods 41. In particular, very small and accurate adjustments to the position of the burner port body with respect to the burner housing can be made by virtue of the screw-threaded connection. Moreover, by making an identical adjustment to each of the adjustment rods 40 the position of the burner port body with respect to the article to be treated (for example a moving web) can be adjusted consistently along the whole length of the burner port body 28 and therefore across the width of, for example, the web disposed below.

The invention is not restricted to the details of the foregoing embodiment. For example, although in the embodiment described the adjusting rods 41 are screw-threadedly engaged with respect to the burner housing 12 and rotatably mounted with respect to the burner porting arrangement 38, this may be reversed such that the adjusting rods 41 are rotatably mounted with respect to the burner housing and screw-threadedly engaged with respect to the burner porting arrangement 38.

What is claimed is:

1. A burner assembly (10) comprising a housing (12) to which a combustible fuel is supplied and a burner port (38) for discharge of combustion products from the burner assembly, wherein the position of the burner port (38) is adjustable with respect to the housing (12).

2. A burner assembly as claimed in claim 1, comprising a burner port body (28) in which the burner port (38) is provided and wherein the burner port body (28) is movable with respect to the housing (12).

3. A burner assembly as claimed in claim 2, wherein the burner port body (28) is provided with a plurality of burner ports (38).

4. A burner assembly as claimed in claim 2, wherein the housing (12) comprises a recess or aperture (26) within which the burner port body (28) is movably located.

5. A burner assembly as claimed in claim 4, wherein the burner port body (28) is slidably mounted in the recess or aperture (26).

6. A burner assembly as claimed in claim 4, wherein the recess or aperture (26) comprises two opposed, substantially parallel walls and the burner port body (28) comprises two substantially parallel outer wall surfaces, each of which is in sliding engagement with a respective one of the two opposed walls of the recess or aperture (26).

7. A burner assembly as claimed in claim 6, wherein the burner port body (28) comprises two, substantially parallel walls (32) and the port (38) is located between the walls (32).

8. A burner assembly as claimed in claim 1, further comprising means (40) for adjusting the position of the burner port (38) with respect to the housing (12).

9. A burner assembly as claimed in claim 8, comprising an adjusting rod (41) connected to the burner housing (12) and to the burner port (38).

10. A burner assembly as claimed in claim 9, wherein the adjusting rod (41) is screw-threadedly engaged with respect to one of the burner housing (12) and the burner port (38).

11. A burner assembly as claimed in claim 9, wherein the adjusting rod (41) is rotatably mounted with respect to one of the burner housing (12) and the burner port (38).

12. A burner assembly as claimed in claim 9, comprising a plurality of screw-threaded adjusting rods (41).

13. A burner assembly as claimed in claim 1, further comprising a cooling chamber (30) for receipt of cooling fluid.

14. A burner assembly as claimed in claim 13, comprising two cooling chambers (30), located on opposite sides of the burner port (38).

15. A burner assembly as claimed in claim 1, wherein the burner housing (12) and the burner port (38) are elongate.

16. A burner assembly as claimed in claim 15, wherein the cross-sectional area of the housing varies along its width.

17. A burner comprising a plurality of burner assemblies as claimed in claim 15 arranged end to end.

* * * * *